US008136812B2

(12) United States Patent
Yamashita

(10) Patent No.: US 8,136,812 B2
(45) Date of Patent: Mar. 20, 2012

(54) SHEET STACKER AND FINISHER FURNISHED WITH THE SAME

(75) Inventor: Masashi Yamashita, Kofu (JP)

(73) Assignee: Nisca Corporation, Minamikoma-gun (JP)

( * ) Notice: Subject to any disclaimer, the term of this patent is extended or adjusted under 35 U.S.C. 154(b) by 91 days.

(21) Appl. No.: 12/186,542

(22) Filed: Aug. 6, 2008

(65) Prior Publication Data

US 2009/0039590 A1 Feb. 12, 2009

(30) Foreign Application Priority Data

Aug. 6, 2007 (JP) ..... 2007-203767

(51) Int. Cl.
*B65H 7/02* (2006.01)
*B65H 33/04* (2006.01)

(52) U.S. Cl. ..... 271/265.01; 271/265.02; 271/259; 270/58.08; 270/58.12

(58) Field of Classification Search ..... 271/221, 271/223, 265.02, 265.01, 259; 270/58.12, 270/58.08
See application file for complete search history.

(56) References Cited

U.S. PATENT DOCUMENTS

| | | | | |
|---|---|---|---|---|
| 5,172,898 | A * | 12/1992 | Takahashi | 271/10.11 |
| 6,601,846 | B2 * | 8/2003 | Saito et al. | 271/226 |
| 7,172,187 | B2 * | 2/2007 | Terao et al. | 270/58.08 |
| 7,185,883 | B2 * | 3/2007 | Kato et al. | 270/58.11 |
| 7,455,284 | B2 * | 11/2008 | Kotani | 270/58.04 |
| 7,510,177 | B2 * | 3/2009 | Nagata et al. | 270/58.08 |
| 7,841,596 | B2 * | 11/2010 | Okumura et al. | 271/270 |
| 7,946,564 | B2 * | 5/2011 | Iguchi et al. | 270/37 |

FOREIGN PATENT DOCUMENTS

| | | |
|---|---|---|
| JP | 2003-267622 A | 9/2003 |
| JP | 2006-248684 A | 9/2006 |

* cited by examiner

*Primary Examiner* — Michael McCullough
*Assistant Examiner* — Luis A Gonzalez
(74) *Attorney, Agent, or Firm* — Judge Patent Associates

(57) ABSTRACT

Affords sheet stacking device that, in stacking sheets onto a loading tray, enables stacking of the sheets always in the correct posture regardless of the nature of the sheets' surface material. The sheet stacking device includes a tray unit located downstream of a sheet discharging port, a sheet-end regulating member provided on the tray unit, a conveying unit for transporting sheets carried out onto the tray unit though the sheet discharging port, toward the sheet-end regulating member, and a conveyance controller for controlling the conveying unit. In conveying toward the sheet-end regulating member a sheet having been carried onto the tray unit, the conveyance controller varies the running time during which the conveying unit applies conveyance force to the sheet, in accordance with the material nature of the sheet surface.

14 Claims, 8 Drawing Sheets

SHEET STACKER AND FINISHER FURNISHED WITH THE SAME

BACKGROUND OF THE INVENTION

1. Technical Field

The present invention—involving sheet stacking devices, and finishers furnished with the devices, that stack/store on a tray sheets carried out from, typically, an image-forming apparatus—relates to improvements in sheet storing mechanisms that orderly store sheets against a regulating stop on the tray.

2. Description of the Related Art

In general, sheet stacking devices of this sort are known broadly as devices that are provided with a loading tray forming a path break downstream of the sheet discharging port, and that stack/store onto the loading tray sheets turned out from the sheet discharging port by a sheet discharging roller. The loading tray may be configured as a stack tray that simply houses the sheets, or may be configured as a processing tray that subjects the sheets to final-stage processing.

In particular, if the loading tray is configured as a processing tray, a sheet aligning mechanism is required to load the sheets (bundle) on the tray and subject the sheets to final-stage processing such as stapling, punching, or stamping. The sheet aligning mechanism, which is thus for positioning/stacking the sheets on the tray in a predetermined position (final-stage processing position), is constituted by a regulating stop on the loading tray, against which one end (leading end or trailing end) of the sheets abuts and is thereby regulated, and conveying means for conveying the sheets toward the stop.

For example, Japanese Unexamined Pat. App. Pub. No. 2003-267622 (cf. FIG. 2 in particular) discloses a device that stacks and collates on a processing tray sheets carried out from an image forming apparatus through a sheet discharging port, and staple-binds sheet bundles stacked on the processing tray. Therein, the processing tray is provided with a stop member against which sheet ends abut and are thereby regulated, as well as a conveying member (a "paddle member" in Japanese Unexamined Pat. App. Pub. No. 2003-267622) above the processing tray, for transporting toward the stop member sheets carried in through the sheet discharging port.

Similarly, Japanese Unexamined Pat. App. Pub. No. 2006-248684 (cf. FIG. 2 in particular) discloses a sheet storing mechanism that carries out onto the processing tray sheets from the sheet discharging port, and that, with a belt member disposed above the tray to let it elevate/lower, aligns the sheets by their abutting against a regulating stop.

In either of the conventional sheet storing mechanisms disclosed in Japanese Unexamined Pat. App. Pub. Nos. 2003-267622 and 2006-248684, to align against the regulating stop sheets carried in onto the tray, the conveying means (paddle or belt member), which applies a conveyance force on the sheets, aligns them using a preset conveyance force and running time (design parameters).

In implementations in which, as described above, sheets are carried in onto a loading tray disposed downstream of the sheet discharging port and aligned in the predetermined position (final-stage processing position, etc.), a conveying rotor (roller, belt, or the like) that moves up and down in accordance with the amount of sheets loaded is provided on the tray, and by means of the rotor, sheets are abutted against the regulating stop and are thereby aligned. Any of various and diverse mechanisms, such as a roller member, a belt member, or a paddle member, is conventionally employed as the conveying mechanism, which transports sheets on the tray toward the regulating stop for positioning.

Therein, a sheet-feeding rotor that in this manner conveys a sheet on the tray toward the regulating stop halts it immediately after the sheet leading end has abutted against the regulating stop, to prevent the sheet from being damaged by being over-conveyed.

The conveyance force that the sheet-feeding rotor imparts to the sheets by is conventionally set at a defined value (design parameter). Consequently, when the material nature of the sheet surface differs the conveyance force imparted to the sheet varies, giving rise to registration or skewing problems, in which the sheets fail to reach the regulating stop reliably, or to problems of damage, such as leading-end crumpling, affecting sheets having abutted against the regulating stop.

In particular, for sheets subjected to final-stage processing, a recent trend is to use sheets differing significantly in the material nature of the surface, such as color copy sheets and monochromatic copy sheets. In such cases, mixing for example gloss paper, whose surface coefficient of friction is low, with plain paper, whose coefficient of friction is relatively large, may lead to the former not reaching the regulating stop (registration problem) or to skewing, and may lead to sheet damage such as leading end crumpling in the latter.

To solve such problems, for example, the engaging force between the sheet-feeding rotor and the sheets on the tray could be more/less adjusted. However, in a situation, for example, in which color images alternate with monochromatic images on sheet by sequentially conveyed sheet, the above-described problem cannot be solved unless the pressure-contact force of the sheet-feeding rotor is adjusted for each sheet. Accordingly, adjustment of the pressure-contact force of the sheet-feeding rotor requires complicated mechanisms and controls.

BRIEF SUMMARY OF THE INVENTION

Under these circumstances, the present inventors arrived at the concept of varying the running time of the sheet-feeding rotor depending on the nature of the paper material of the sheets conveyed, or detecting the time that the sheets are conveyed until they reach the loading tray, and varying the running time of the sheet-feeding rotor in accordance with how long/short the conveyance period is.

A main object of the present invention is to provide a sheet stacking device that, when sheets are aligningly stacked at the regulation stop located on the loading tray, can always stack the sheets in the correct posture regardless of the material nature of the sheet surface.

Another object of the present invention is to provide a sheet stacking device and a finisher which, when the sheets are loaded and stored, can always stack the sheets in the correct posture without being affected by the material nature of the sheets or environmental conditions such as temperature and humidity.

To accomplish the above-described objects, the present invention adopts the following configuration. A sheet stacking device comprises a sheet discharging port through which sheets are sequentially carried out, tray means (for example, a processing tray 20 described below) located downstream of the sheet discharging port, a sheet-end regulating member (20*a* described below) provided on the tray means, conveying means (for example, belt transporting means 17 described below) for transporting the sheet carried out onto the tray means though the sheet discharging port, toward the sheet end regulating means, and conveyance control means for controlling the conveying means. In conveying the sheet carried onto the tray means toward the sheet-end regulating member, the conveyance control means varies the running time during which the conveying means applies a conveyance force to the sheet, depending on a material nature of the sheet surface.

A sheet discharging path is connected to the sheet discharging port to feed the sheet. The sheet discharging port includes sensor means for detecting a moving time of the sheet being conveyed. The conveyance control means sets a time during which the conveying means applies the conveyance force to the sheet on the basis of a pass time of the sheet determined on the basis of an output signal from the sensor means. In this case, the sensor means comprises (1) a sensor that senses a leading end and a trailing end of the moving sheet or (2) a sensor that senses the sheet moving over a predetermined distance.

The conveyance control means comprises comparing means for comparing the pass time of the sheet determined on the basis of the output signal from the sensor means with a preset reference sheet pass time. The conveyance control means sets the running time during which the conveying means applies the conveyance force to the sheet, on the basis of a result of the comparison from the comparing means.

The conveyance control means comprises input means for inputting a material nature of the sheet surface to the device and sets the running time during which the conveying means applies the conveyance force to the sheet, on the basis of information input by the input means.

The conveying means comprises a belt member located between the sheet discharging port and an uppermost sheet on the tray means.

A finisher according to the present invention comprises a processing tray on which sheets carried out from an image forming apparatus are set in a bundle, final-stage processing means for subjecting the sheet bundle on the processing tray to final-stage processing, a sheet-end regulating member provided on the processing tray, conveying means for transporting the sheet carried out onto the processing tray through the sheet discharging port, toward the sheet-end regulating member, and conveyance control means for controlling the conveying means. In conveying the sheet carried onto the tray means toward the sheet-end regulating member, the conveyance control means varies the running time during which the conveying means applies a conveyance force to the sheet, depending on a material nature of the sheet surface.

According to the present invention, when the sheet carried out onto the tray means through the sheet discharging port is allowed to abut against the regulating stop for alignment, the running time during which the conveying means applies the conveyance force to the sheet is varied depending on the material nature of the sheet surface. The present invention thus exerts the following effects.

Even when the sheet stacked on the tray means differs in the nature of its surface material, the sheet is transported toward the regulating stop using the running time corresponding to the nature of the material. The sheet can thus be orderly stacked on the tray at a predetermined position.

In particular, the material nature of the sheet surface is detected on the basis of the time required to convey the sheet to the sheet discharging port. The sheet on the tray is transported toward the regulating stop according to the sheet conveying time. Thus, even a sheet that differs significantly in the nature of its surface material can be loaded and stored in a predetermined reference position. This enables, for example, a sheet comprising coating paper (gloss paper or the like) on which a color image is printed and a sheet comprising plain paper on which a monochromatic image is printed to be orderly stacked and stacked at the reference position.

The remaining part of the configuration requires only the adjustment of the length of the running time of the conveying means; the conveying means may be a roller, a belt, or a paddle located on the tray means. Therefore, the apparatus can be inexpensively configured to have a very simple structure.

BRIEF DESCRIPTION OF THE SEVERAL VIEWS OF THE DRAWINGS

FIG. 3 is diagrams illustrating how a sheet is stacked on a processing tray in the apparatus shown in FIG. 2, wherein

FIG. 4 is diagrams illustrating states in stacking a sheet onto a processing tray in the apparatus shown in FIG. 2, wherein

DETAILED DESCRIPTION OF THE INVENTION

Figure 1:
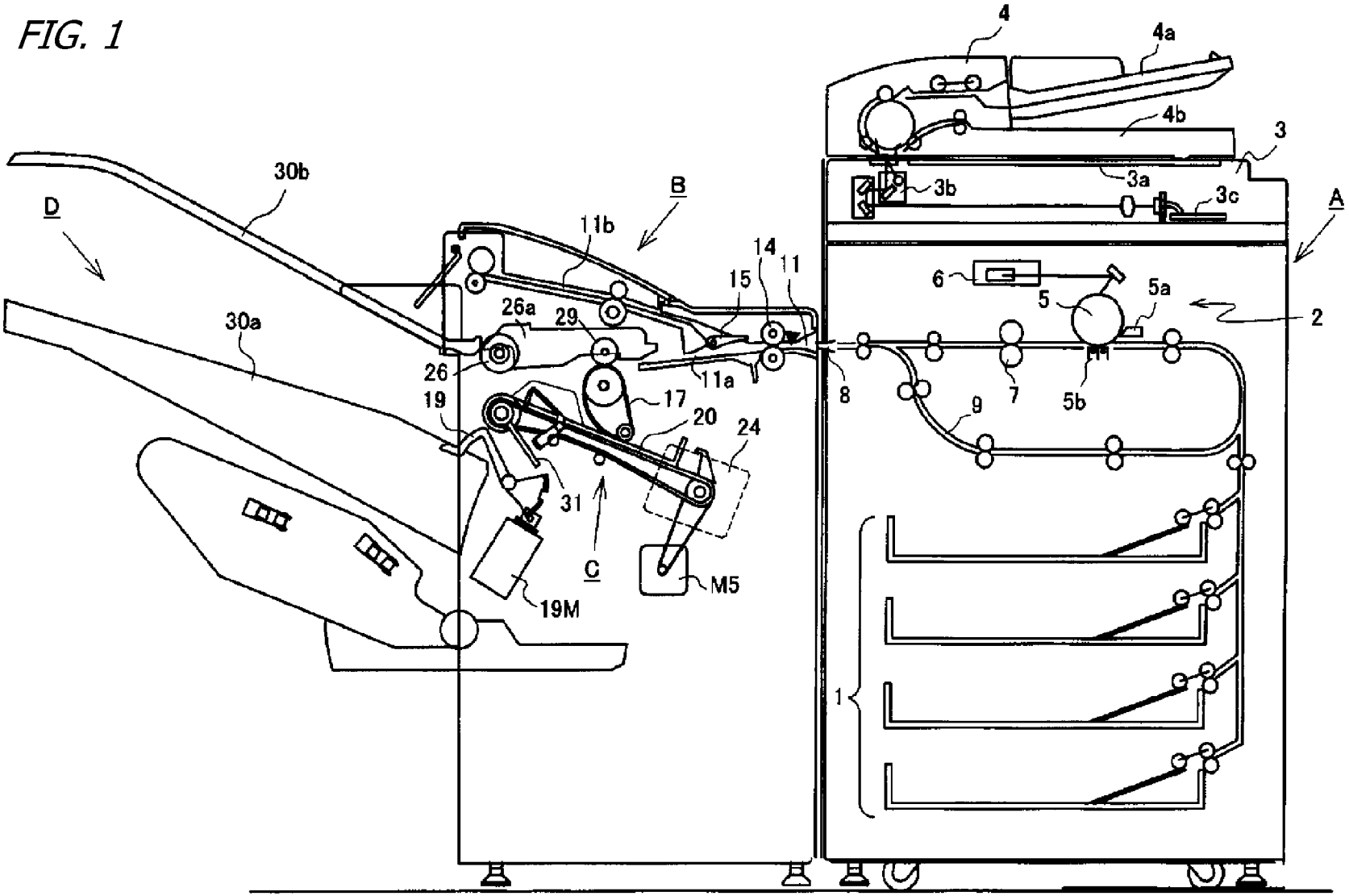
FIG. 1 is a diagram generally illustrating an image forming system composed of a finisher comprising a sheet stacking device according to the present invention, and an image forming apparatus that carries out sheets to the finisher.
Figure 2:
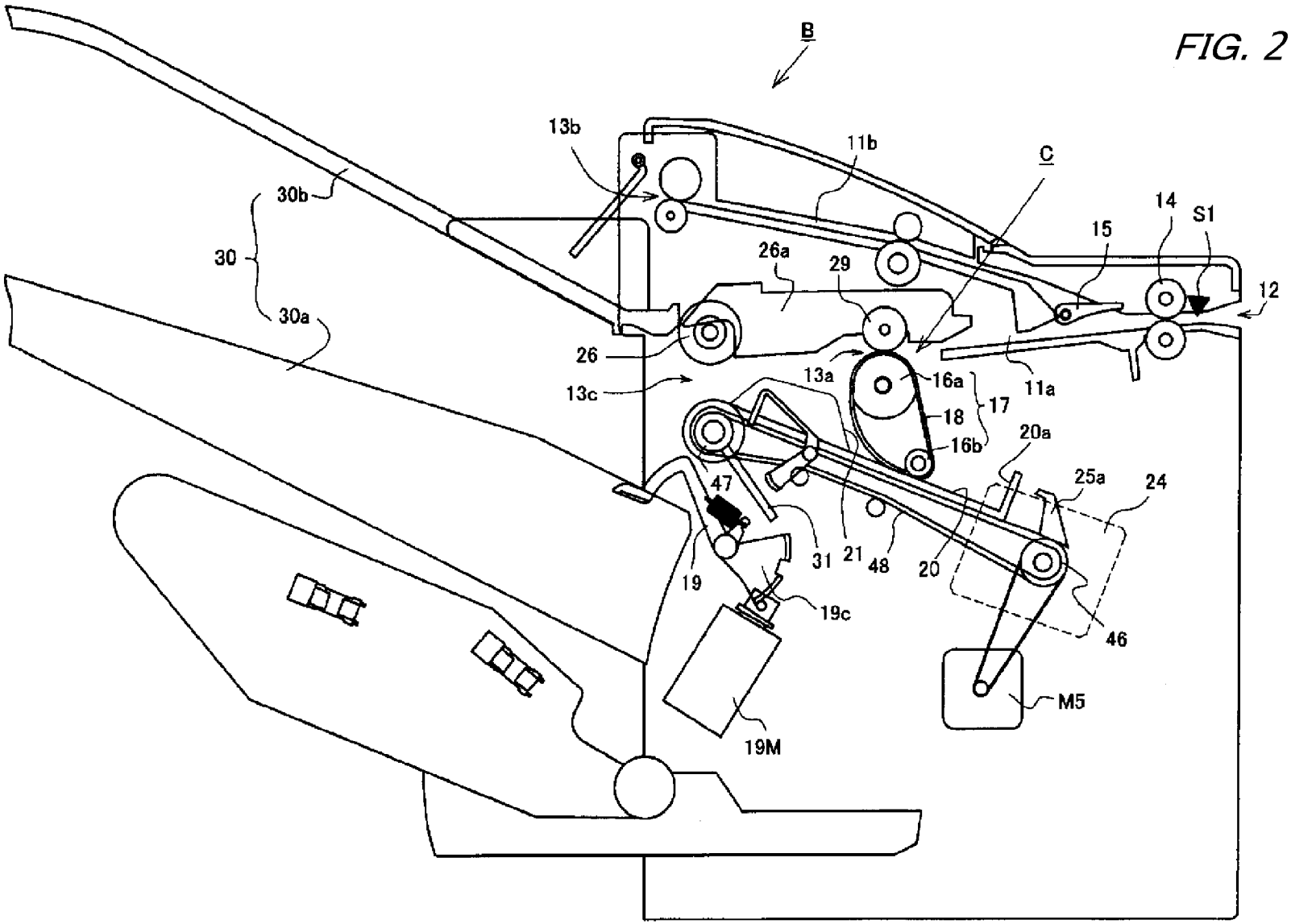
FIG. 2 is an enlarged diagram of an essential part of the finisher in the system shown in FIG. 1.

The present invention will be described below on the basis of an illustrated embodiment. FIG. 1 is a diagram generally illustrating a system comprising a finisher comprising a sheet stacking device according to the present invention, and an image forming apparatus that carries out sheets to the finisher. FIG. 2 is an enlarged diagram of an essential part of the finisher. The "image forming system" and the "finisher" will be described below in this order.

Image Forming System

The image forming system shown in FIG. 1 is composed of an image forming apparatus A and a finisher B. A sheet stacking device C is incorporated in the finisher B. The image forming apparatus A is composed of a sheet feeding stacker 1, an image forming section 2 that forms an image on a sheet from the sheet feeding stacker 1, a scanner section 3, and a document feeding section 4. The image forming section 2 is composed of an electrostatic printing mechanism, an ink jet printing mechanism, an offset printing mechanism, or the like. The image forming section 2 is configured to copy and print image data optically read by the scanner section 3, on a sheet from the sheet feeding stacker 1. The illustrated image forming section 2 is an electrostatic printing mechanism including a developing member 5*a*, a charger 5*b*, and a print head 6 arranged around a photosensitive drum 5. The print head 6 forms an electrostatic latent image on the photosensitive drum 5. The developing member 5*a* applies toner ink to the electrostatic latent image. The charger 5*b* transports the image to the sheet for printing. A fixer 7 fixes the image to the sheet to which the toner ink has been transported. The resulting sheets are sequentially carried out through the sheet discharging port 8. Illustrated at reference numeral 9 is a circulating path along which a sheet with a printed front surface is fed again to the photosensitive drum 5 and an image is then formed on a back surface of the sheet.

The scanner section 3 is composed of a platen 3*a* on which a document is placed, a reading carriage 3*b* that line-sequentially scans a document image along the platen 3*a*, and a photoelectric converting element 3*c*. The document feeding section 4 is mounted above the scanner section 3*a* to separately feed documents placed and set on a document tray 4*a* to the platen 3*a* and to accommodate the documents on a sheet discharging tray 4*b*. The system also functions as a network printer in such a manner that image data from the external image forming apparatus, for example, a computer, is transported to the print head 6, which forms an image on a sheet on the basis of the data.

Finisher

The finisher B according to the present invention is coupled to the sheet discharging port 8 in the image forming apparatus A. The finisher B sequentially receives sheets with images formed thereon to carry out a "bookbinding process," a "jog process," and a "sheet carry-out (storing) process" on the sheets. Thus, the image forming system shown in FIG. 1 is composed of the image forming apparatus main body comprising a copier, a print function, a facsimile function, and the like, and the finisher coupled to the image forming apparatus main body. The finisher B comprises, as processing operation modes, a series of final-stage processing operations such as a binding process of setting and binding sheets with images formed thereon according to page number and the jog process of sorting and storing the set sheets before discharging. To control each operation mode, an operator sets, on the image forming apparatus A, a print mode such as the number of sheets to be printed and a printing function and simultaneously sets a final-stage processing mode such as the "binding process," the "jog process," or the "sheet carry-out (storing) process." In accordance with a command signal from the image forming apparatus A, the finisher B carries out a process according to the operation mode.

The finisher B shown in FIG. 2 is composed of a sheet discharging path 11 which receive sheets sequentially discharged by the above-described image forming apparatus A and which carry out the sheets downstream, a processing tray 20 ("tray means"; this also applies to the description below) located below a sheet discharging port (sheet discharging port in the finisher B) 13*a* of the sheet discharging path 11, and a storing tray 30 located downstream of the processing tray 20. A carry-in roller 14 is provided on the sheet discharging path 11 to convey a sheet fed toward a carry-in port 12. The carry-in roller 14 is composed of a pair of rollers that are in pressure contact with each other. The sheet discharging path 11 also includes an inlet sensor S1 that detects a leading end and a trailing end of a conveyed sheet.

The sheet discharging path 11 diverges into a first sheet discharging path 11*a* and a second sheet discharging path 11*b*. The processing tray 20 (tray means; this also applies to the description below), described below, is located downstream of the first sheet discharging path 11*a*. A first storing tray 30*a* is located downstream of the processing tray 20. A second storing tray 30*b* is located on the second sheet discharging path 11*b*.

That is, a sheet from the image forming apparatus A is guided to the carry-in path 11 by the carry-in roller 14 and selectively fed to the first sheet discharging path 11*a* or the second sheet discharging path 11*b* via a path switching piece 15. The processing tray 20 is located downstream of a sheet discharging port (hereinafter referred to as a "first sheet discharging port") 13*a* of the first sheet discharging path 11*a*. The second storing tray 30*b* is located at a sheet discharging port (hereinafter referred to as a "second sheet discharging port") 13*b* of the second sheet discharging path 11*b*. Thus, sheets from the image forming apparatus A are selectively guided toward the processing tray 20 via the path switching piece 15 or to the second storing tray 30*b*. The sheets guided to the processing tray 20 are set in a bundle, subjected to final-stage processing such as stapling, and then stored on the first storing tray 30*a*, provided downstream of the processing tray 20. On the other hand, the sheets guided toward the second storing tray 30*b* are stacked on the second storing tray 30*b* without being post-processed.

Configuration of Processing Tray

The processing tray 20 is located below the first sheet discharging port 13*a* so as to form a step. Sheets are temporarily placed and supported on the processing tray 20 and post-processed in this condition. A mechanism corresponding to the functions of the final-stage processing carried out on the sheets is incorporated in the processing tray 20. The illustrated processing tray 20 comprises the "bookbinding function," the "jog function," and the "sheet carry-out function" of carrying out sheets from the first sheet discharging port 13*a* directly (without final-stage processing) to the downstream first storing tray 30*a*.

The "bookbinding function" stacks and staples a series of sheets carried out from the image forming apparatus A, on the processing tray 20 according to page number, and carries out the resulting sheet bundle to the first storing tray 30*a* for storing. The "jog function" sorts, stores, and sets the series of sheets carried out from the image forming apparatus A, on the first storing tray 30*a*. Thus, the processing tray 20 comprises a jog shift mechanism that shifts each of the sheets in a direction orthogonal to a conveying direction by a predetermined amount. The illustrated jog shift mechanism, biasing aligning means (side regulating means 21 described below) provides this function. Forward/reverse roller means 26 is located on the processing tray 20.

A staple device (final-stage processing means, shown in FIG. 2) 24, the sheet-end regulating member 20*a*, the conveying means ("forward/reverse roller means 26" and "belt transporting means 17" described below), and the side regulating means 21 are arranged on the processing tray 20; the sheet end regulating means 20*a* positions and aligns each of the sheets with the final-stage processing position, and the conveying means transports the sheet to the sheet-end regulating member. The sheet-end regulating member 20*a* is formed to project upward from the processing tray 20 so that the leading or trailing end of the sheet in the conveying direction abuts against the sheet end regulating means 20*a* for regulation. Similarly, the side regulating member 21 is formed to project upward from the processing tray 20 so that a side edge of the sheet which is orthogonal to the sheet conveying direction abuts against the side regulating member 21.

Configuration of Conveying Means

A sheet discharging roller 29 is located at the sheet discharging port 13*a*. The illustrated sheet discharging roller 29 is in pressure contact with a driving end of a caterpillar belt 18 described below to carry out the sheet upward from the tray through the sheet discharging port 13*a*. The sheet discharging roller 29 may be composed of a pair of rollers that is not in pressure contact with the caterpillar belt 18 as shown in the figure.

The forward/reverse roller means 26 and the belt transporting means 17 are arranged on the processing tray 20; the forward/reverse roller means 26 conveys the sheet carried onto the tray, toward a downstream side and then switches the sheet back to an upstream side, and the belt transporting means 17 transports the sheet fed by the roller means, to the regulating member 20*a*. The forward/reverse roller means 26 and the belt transporting means 17 constitute the conveying means for "transporting the sheet carried out through the sheet discharging port, toward the sheet-end regulating member." Thus, the forward/reverse roller means 26 is supported by a swinging bracket 26*a* so as to be movable up and down with respect to the processing tray 20. The forward/reverse roller means 26 is coupled to a shift motor (not shown in the drawings). A forward reverse motor (not shown in the drawings) is coupled to the forward/reverse roller 26.

The belt transporting means 17 is composed of a pair of pulleys 16*a* and 16*b* between which the caterpillar belt 18 extends as shown in FIG. 2. The belt transporting means 17 is located between the sheet discharging port 13*a* and the processing tray 20 so as to be movable up and down along the sheet conveying direction (to and from the sheet-end regulating member 20*a*). That is, a driving motor M1 is coupled to the driving pulley 16*a*. The driven pulley 16*a* moves up and down according to the amount of sheets loaded on the tray. The caterpillar belt 18 is wound between the pulleys. Thus, the illustrated apparatus is configured so that the sheet carried onto the tray is transported to the sheet-end regulating member 20*a* by the forward/reverse roller means 26 and the belt transporting means 17. Of course, the "conveying means," composed of the forward/reverse roller means 26 and the belt transporting means 17, may be composed of only the forward/reverse roller or the belt transporting means.

The final-stage processing means, in the figure, the staple device 24, is located on the processing tray 20 configured as described above. The sheet from the sheet discharging port 13*a* is carried onto the processing tray 20 by the forward/reverse roller means 26 and the belt transporting means 17. The trailing end of the sheet advances onto the processing tray 20. The forward/reverse roller means 26 is reversed to switch back the sheet, which thus advances to the lower half portion of the belt of the belt transporting means 17. Subsequently, the belt transporting means 17 allows the trailing end of the sheet to abut against the sheet-end regulating member 20*a* for regulation.

Sheet push-out means 25 (sheet discharging means; this also applies to the description below) is located on the processing tray 20 as described below in order to transport the post-processed sheet to the downstream first storing tray 30*a*. A guide groove (not shown in the drawings) along which a push-out pawl 25*a* moves is provided in the center of the processing tray 20 in a sheet width direction. The push-out pawl 25*a* transports the sheet positioned on the downstream sheet-end regulating member 20*a* to the sheet discharging port 13*c* (hereinafter referred to as a "third sheet discharging port") along the guide groove. To achieve this, a belt member 48 is extended between a pair of pulleys 46 and 47 provided on a rear surface of the processing tray 20, and the push-out pawl 25*a* integrally fixed to the belt member 48. A push-out pawl driving motor M5 is coupled to the pulley 46. Consequently, the sheet push-out pawl driving motor M5 swings the push-out pawl 25*a* so as to longitudinally cross the periphery of the processing tray 20. In addition to the push-out pawl 25*a*, the forward/reverse roller means 26, configured as described above, is provided at the third sheet discharging port 13*c*.

Sheet Stack Device

A sheet stack device D described below is located downstream of the processing tray 20, described above. As shown in FIG. 2, the first storing tray 30*a* is located at the third sheet discharging port 13*c* so as to form a step. As shown in FIG. 2, the first storing tray 30*a* is located at the third sheet discharging port 13*c* so as form a step. As shown in FIG. 2, the first storing tray 30*a* is composed of a tray member attached to an apparatus frame so that the sheet from the third sheet discharging port 13*c* is loaded and stored on the first storing tray 30*a*. The sensor lever 19 is located above the first storing tray 30*a*. The sensor lever 19 is configured to detect whether or not the sheets loaded on the first storing tray 30*a* have reached a maximum allowable amount (sheet full) and/or whether or not any sheet is loaded on the tray (sheet remaining).

Figure 8:
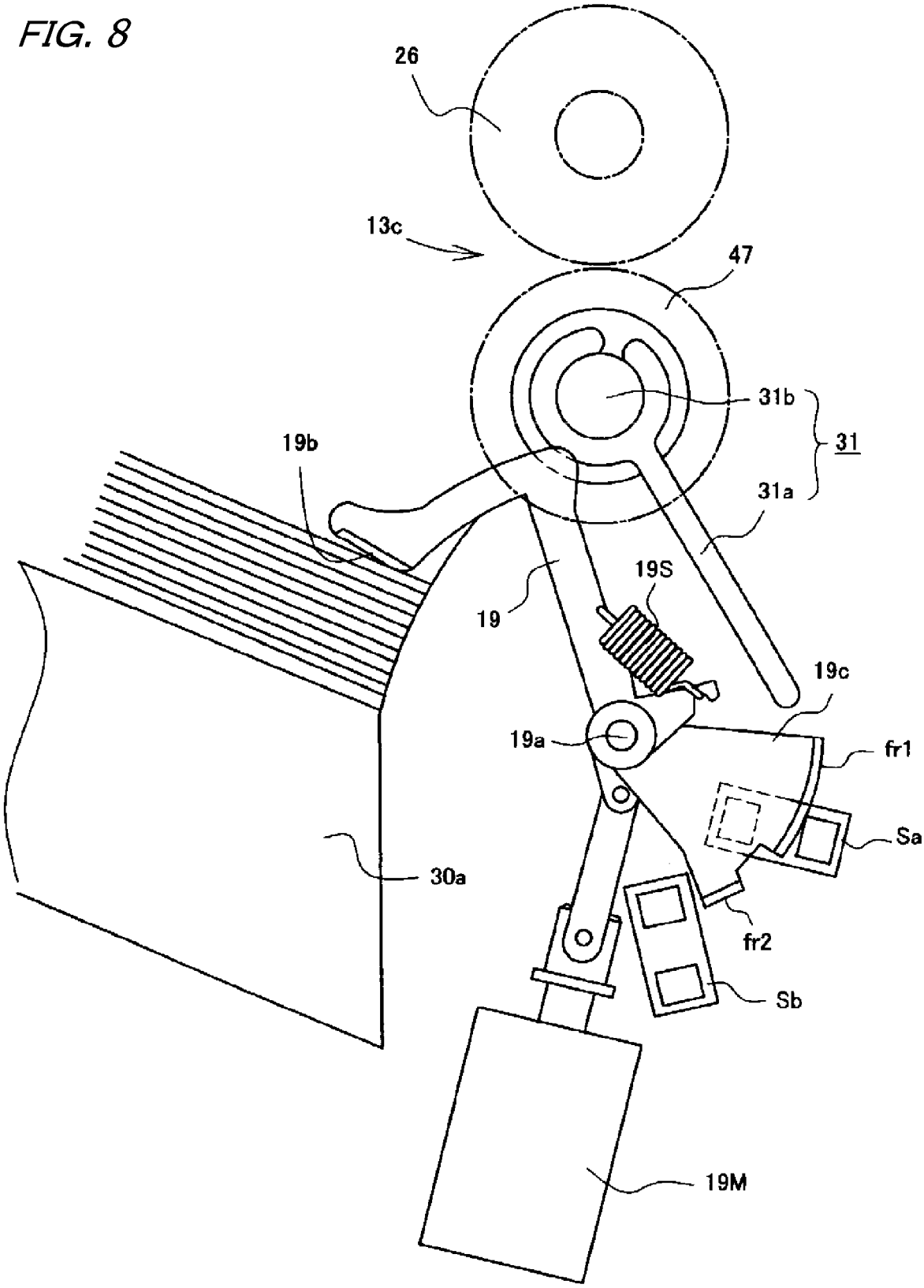
FIG. 8 is a diagram illustrating a sheet detecting mechanism on a storing tray in the apparatus shown in FIG. 2.

Thus, as shown in FIG. 8, the sensor lever 19 is supported on the apparatus frame so as to be pivotable around a support shaft 19*a*. The sensor lever 19 further includes a paper contact piece 19*b* at a leading end thereof and a flag 19*c* at a base end thereof. The paper contact piece 19*b* is configured to swing around a support shaft 19*a* so as to come into contact with the uppermost sheet on the first storing tray 30*a*. The flag 19*c* is configured such that the position thereof is detected by a photosensor. The sensor lever 19 is biased so as to always lie at a retracted portion by a bias spring 19S. The sensor lever 19 is coupled to an electromagnetic solenoid 19M so as to move to a sensing portion against the force of the spring.

The flag 19*c* of the sensor lever 19 comprises a first flag fr1 and a second flag fr2 which, when the paper contact piece 19*b* moves in conjunction with the sheets on the tray, allow "sheet full sensing," "sheet empty sensing," and "lever standby position sensing" to be performed at the corresponding positions. To sense the flags fr1 and fr2, a first sensor Sa and a second sensor Sb are arranged at positions shown in FIG. 8.

Thus, the positional relationship between the first and second flags fr1 and fr2 and the first and second sensors Sa and Sb is set such that when the paper contact piece 19*b* is at the sheet full sensing position, "Sa=ON & Sb=ON," and when the paper contact piece 19*b* is at the sheet empty sensing position on the first storing tray 30*a*, "Sa=OFF & Sb=OFF," and such that when the paper contact piece 19*b* senses a different condition of the paper surface, "Sa=ON & Sb=OFF," and when the paper contact piece 19*b* is at the retracted position (state shown in FIG. 8), "Sa=OFF & Sb=ON."

The present invention is thus characterized by controlling the forward/reverse roller means 26 and the belt transporting means 17 as follows. First, when the leading end of the sheet advances onto the tray, the forward/reverse roller 26 stands by above the tray (condition shown in FIG. 2) so as not to obstruct the sheet. Then, after the leading end of the sheet advances onto the tray, the forward/reverse roller 26 lowers to a position where the forward/reverse roller 26 engages with the sheet on the tray. At the same time, the roller 26 rotates clockwise to convey the sheet downstream. Upon elapse of an expected time required for the trailing end of the sheet to be carried onto the tray, the forward/reverse roller 26 starts rotating counterclockwise. Thus, the forward/reverse roller 26 switches back and conveys the sheet carried onto the tray toward the sheet-end regulating member 20*a*. Then, upon elapse of an expected time required for the trailing end of the sheet to be fed to the belt transporting means 17, the forward/reverse roller 26 retracts upward from the tray. The belt transporting means 17 transports the sheet so that the sheet abuts against the sheet-end regulating member 20*a*.

The driving of the forward/reverse roller means 26 and the belt transporting means 17 is controlled by, for example, a control CPU for the final-stage processing device B. The present invention is thus characterized in that this control CPU ("control means 40"; this also applies to the description below) "varies a driving stop timing for the belt transporting means depending on the material nature of the sheet surface." The control means 40 is configured so as to (1) detect the conveying condition of the sheet to stop the belt transporting means 17 in accordance with the detection result or to (2) stop the belt transporting means 17 in accordance with the sheet-surface material nature input by the operator.

Figure 3A:
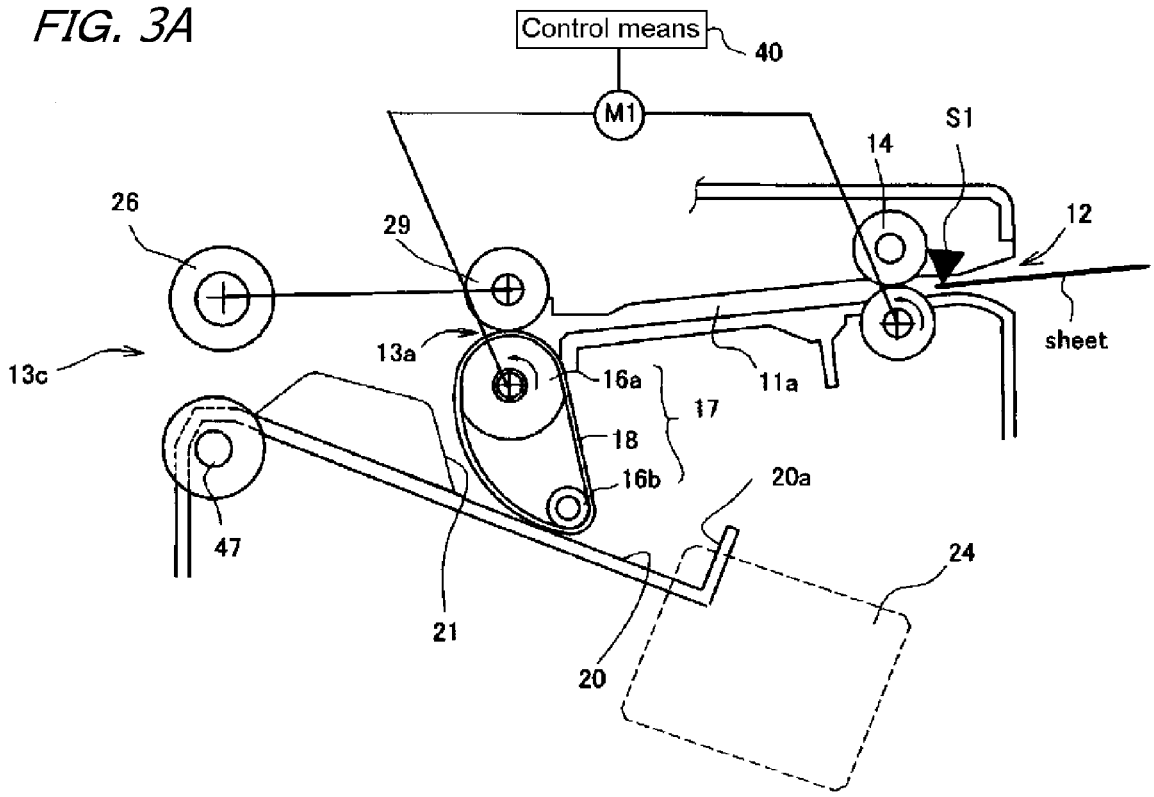
FIG. 3A shows that a leading end of the sheet has been carried into the apparatus.
Figure 4A:
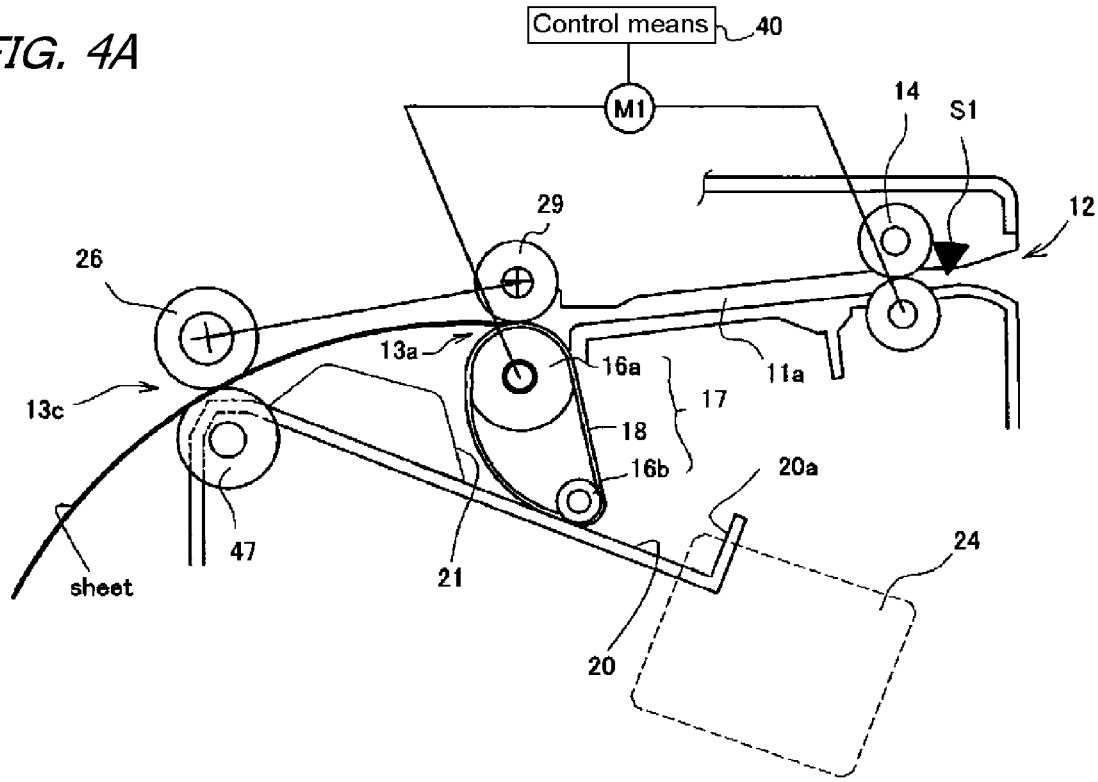
FIG. 4A represents a state in which the trailing end of a sheet has advanced in above the tray.
Figure 5:
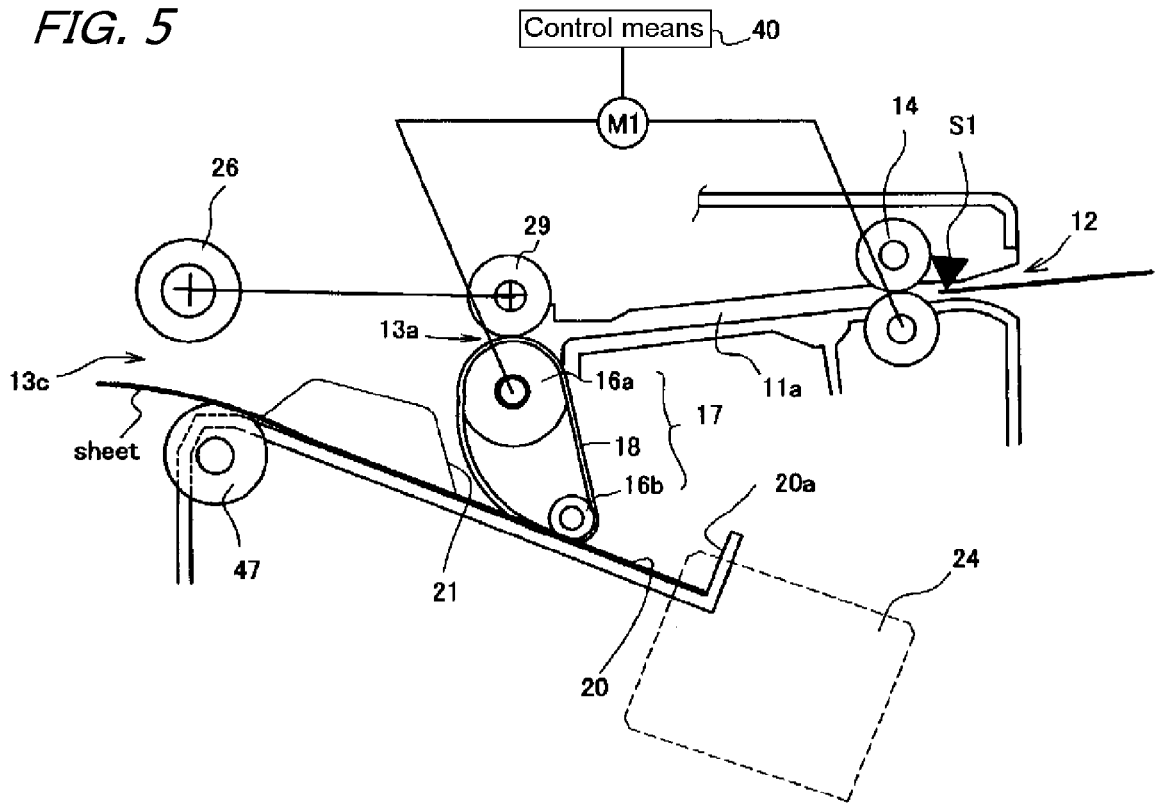
FIG. 5 is a diagram illustrating a state in stacking a sheet onto the processing tray in the apparatus shown in FIG. 2, and represents a state in which the sheet has been aligned with a regulating member on the tray.
Figure 6:
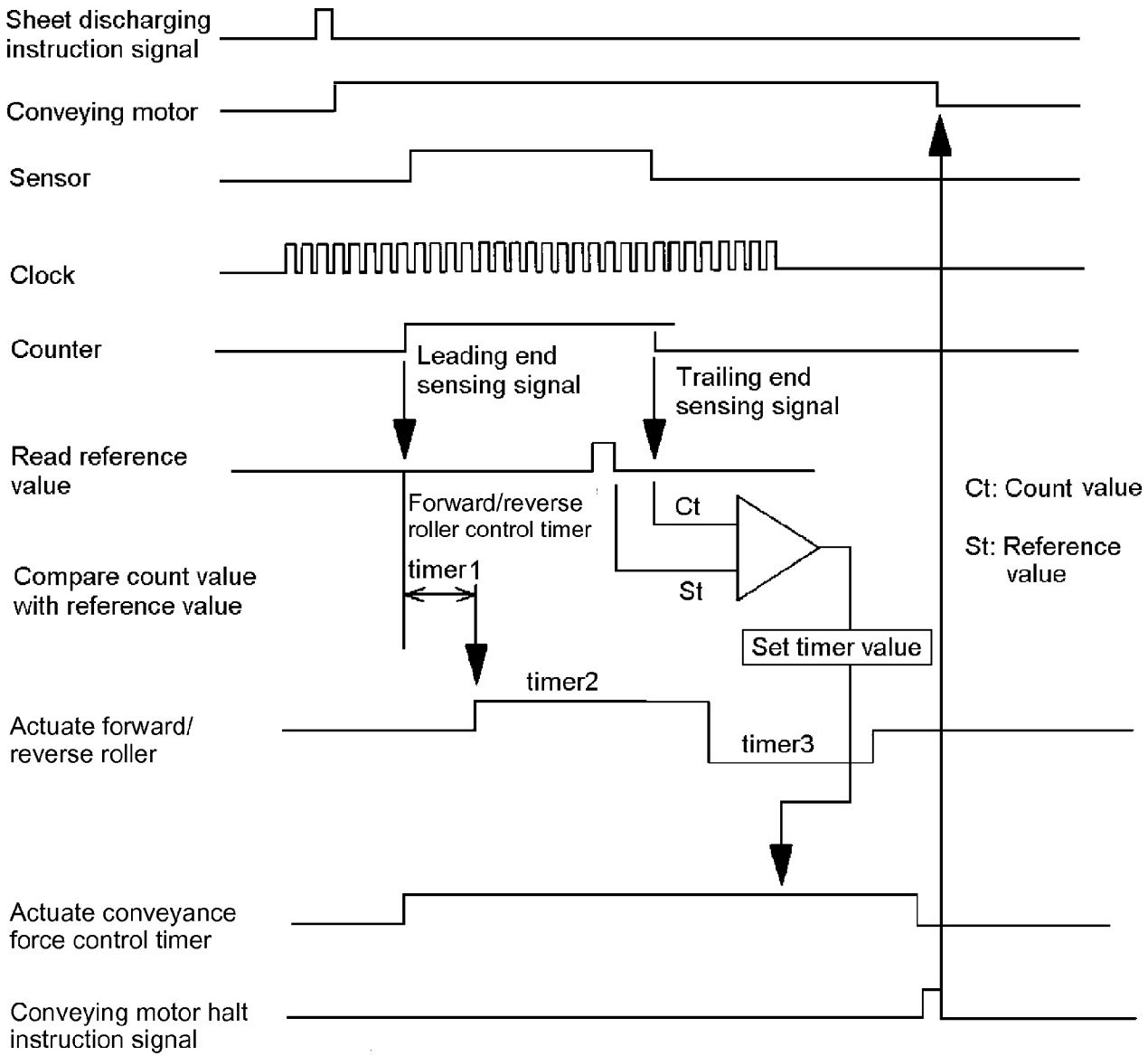
FIG. 6 is a timing chart for explaining states in stacking a sheet onto the processing tray in the apparatus shown in FIG. 2.

The case in which the control means 40 detects the conveying condition of the sheet to control the belt transporting means 17 will be described. FIG. 6 shows a timing chart for this case, and FIGS. 3 to 5 show operating conditions. Description will be given with reference to FIG. 6. The control CPU (not shown in the drawings) receives a sheet discharging instruction signal from the image forming apparatus A and then rotationally controls the carry-in roller 14 and the sheet discharging roller 29 (the illustrated sheet discharging roller 29 is a driving pulley). The rotational driving is performed by the driving motor M1.

Then, the sheet fed to the carry-in port 12 is fed downstream by the carry-in roller 14. The inlet sensor S1 then senses the leading end of the sheet (condition shown in FIG. 3A). The sheet advances onto the processing tray through the sheet discharging port 13*a*. At this time, a counter provided in the control CPU starts measurement with a reference clock. Furthermore, a forward reverse control timer is actuated on the basis of a sheet leading end sensing signal.

Figure 3B:
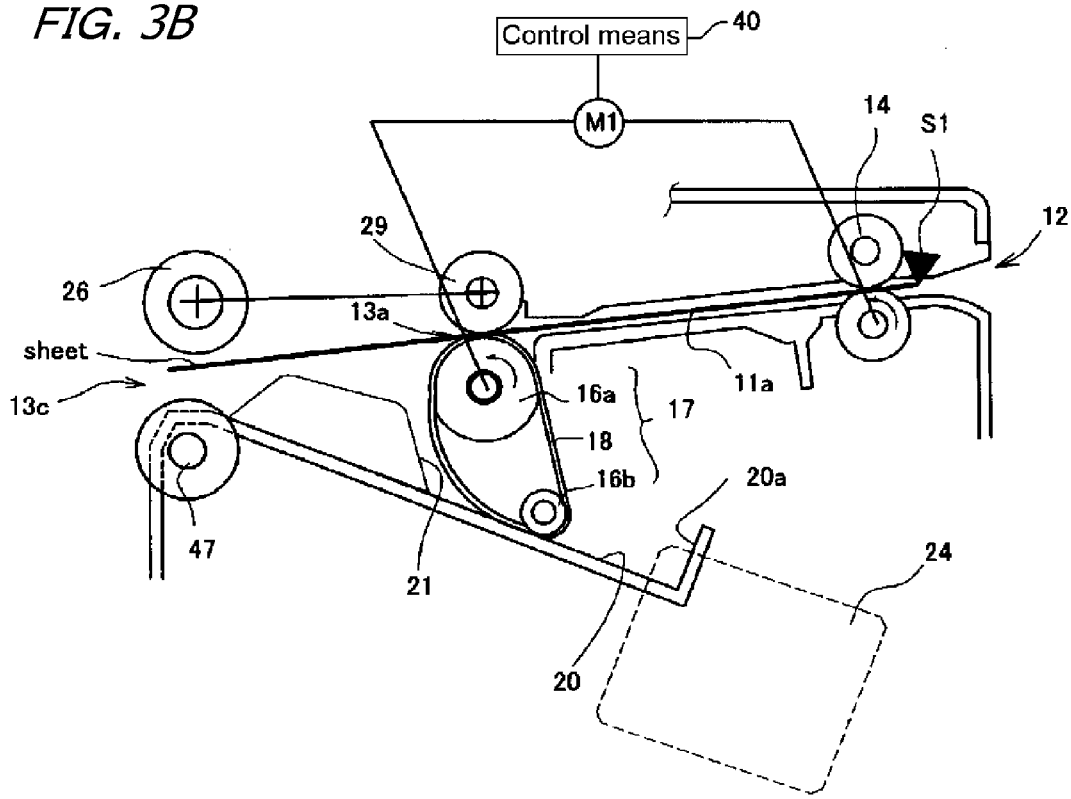
FIG. 3B shows that the leading end of the sheet has been carried onto the processing tray.

Then, when the inlet sensor S1 senses the sheet trailing end, the control means 40 issues a trailing end sensing signal to stop the counter from the clock measurement (condition shown in FIG. 3B). Almost simultaneously with the stop, the control means 40 reads a reference value. The reference value is prepared in, for example, a RAM as a sheet conveying time corresponding to a sheet size. The control means 40 then reads a reference conveying time required to convey the sheet on the basis of the sheet size information pre-received from the image forming apparatus A. The control means 40 then compares the measurement time in the counter with the reference conveying time stored in the RAM.

Then, in response to the leading end sensing signal from the inlet sensor S1, the control means 40 actuates a forward reverse control timer. Upon elapse of an expected time (timer 1) required for the sheet leading end to reach the position of the forward/reverse roller 26, the control means 40 lowers the forward/reverse roller means 26 onto the sheet placed on the tray. Simultaneously with the lowering, the control means 40 rotates the forward/reverse roller means 26 clockwise. Then, the sheet is carried out downstream as shown in FIG. 4A. The sheet trailing end is carried onto the processing tray though the sheet discharging port.

Figure 4B:
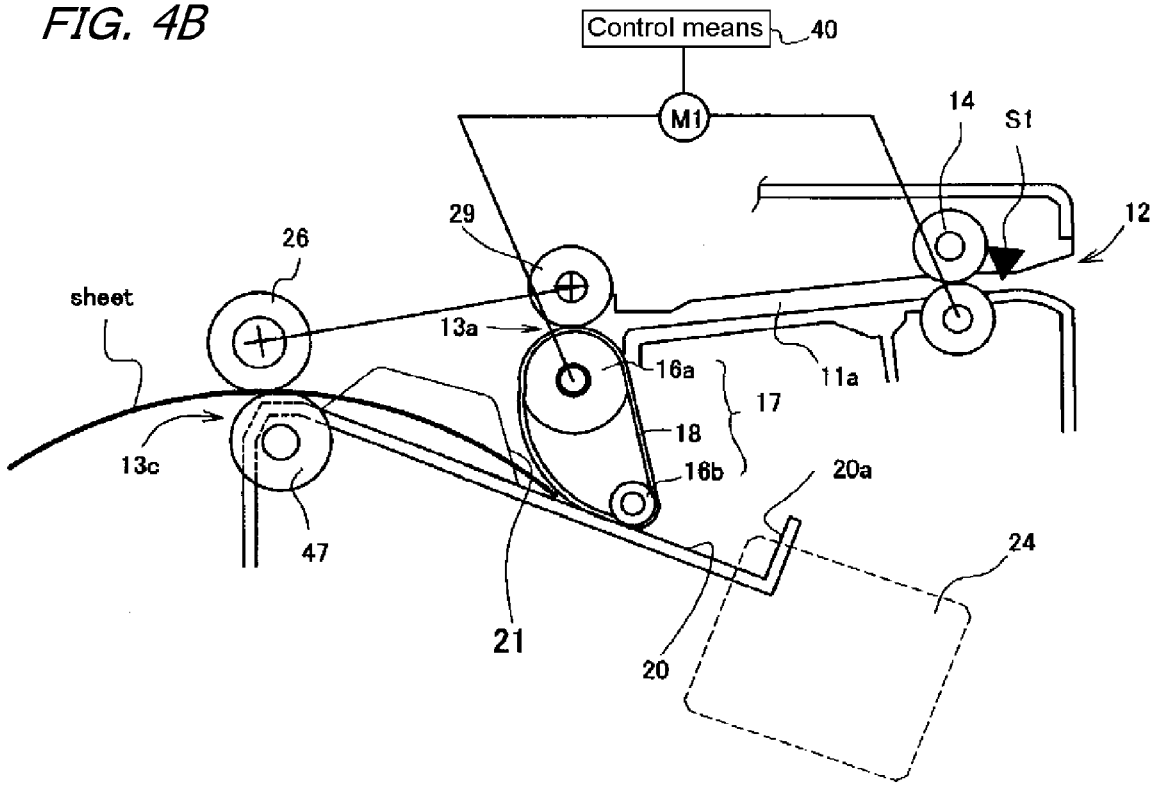
FIG. 4B represents a state in which the sheet aligns with a regulating member on the tray.

Then, upon elapse of an expected time (timer 2) required for the sheet trailing end to advance onto the processing tray, the control means 40 starts rotating the forward/reverse roller 26 in the reverse (counterclockwise) direction (state shown in FIG. 4B). Then, the sheet trailing end is fed toward the sheet end regulating means 20*a* along the processing tray 20 by means of the caterpillar belt 18 of the belt transporting means. Upon elapse of an expected time (timer 3) required for the sheet trailing end to be fed to the belt transporting means 17, the control means 40 moves the forward/reverse roller means 26 upward so that the forward/reverse roller means 26 stands by above the tray.

Then, the control means 40 compares the "sheet conveying time" determined from the sensing signal from the inlet sensor S1 with the prepared "reference conveying time." The control means 40 sets a belt stop time (belt running time) on the basis of the comparison result. As the belt stop time, the time when the caterpillar belt 18 is stopped is determined on the basis of the time when the sheet trailing end is detected by the inlet sensor S1. For example, when the "sheet conveying time" is equal to the "reference conveying time," the sheet is considered to be conveyed without slippage. Then, the belt stop time determined by the control means 40 is set on the basis of a conveying distance over which the sheet trailing end carried out through the sheet discharging port 13*a* travels until the end reaches the sheet-end regulating member 20*a*.

When the "sheet conveying time">"reference conveying time," the sheet is considered to slip while being fed by the forward/reverse roller 26 and the belt transporting means 17. The belt stop time is set equal to the "reference conveying time+slippage amount." For example, in the figure, the "sheet conveying time−reference conveying time" is calculated, and the belt stop time is set in stages according to the calculated value. Alternatively, the "belt stop time" can be set by the calculating means so as to correct the sheet slippage amount on the basis of the "sheet conveying time−reference conveying time."

When the "belt stop time" has passed, the control means 40 stops the driving motor M1 (condition shown in FIG. 5).

In the present invention, the sensor sensing the "moving time" of the sheet traveling along the sheet discharging path 11 is the single sensor S1 located on the sheet discharging path to detect the sheet leading and trailing ends to determine the moving time, as described above. However, the sensor may be configured as described below.

Figure 7:
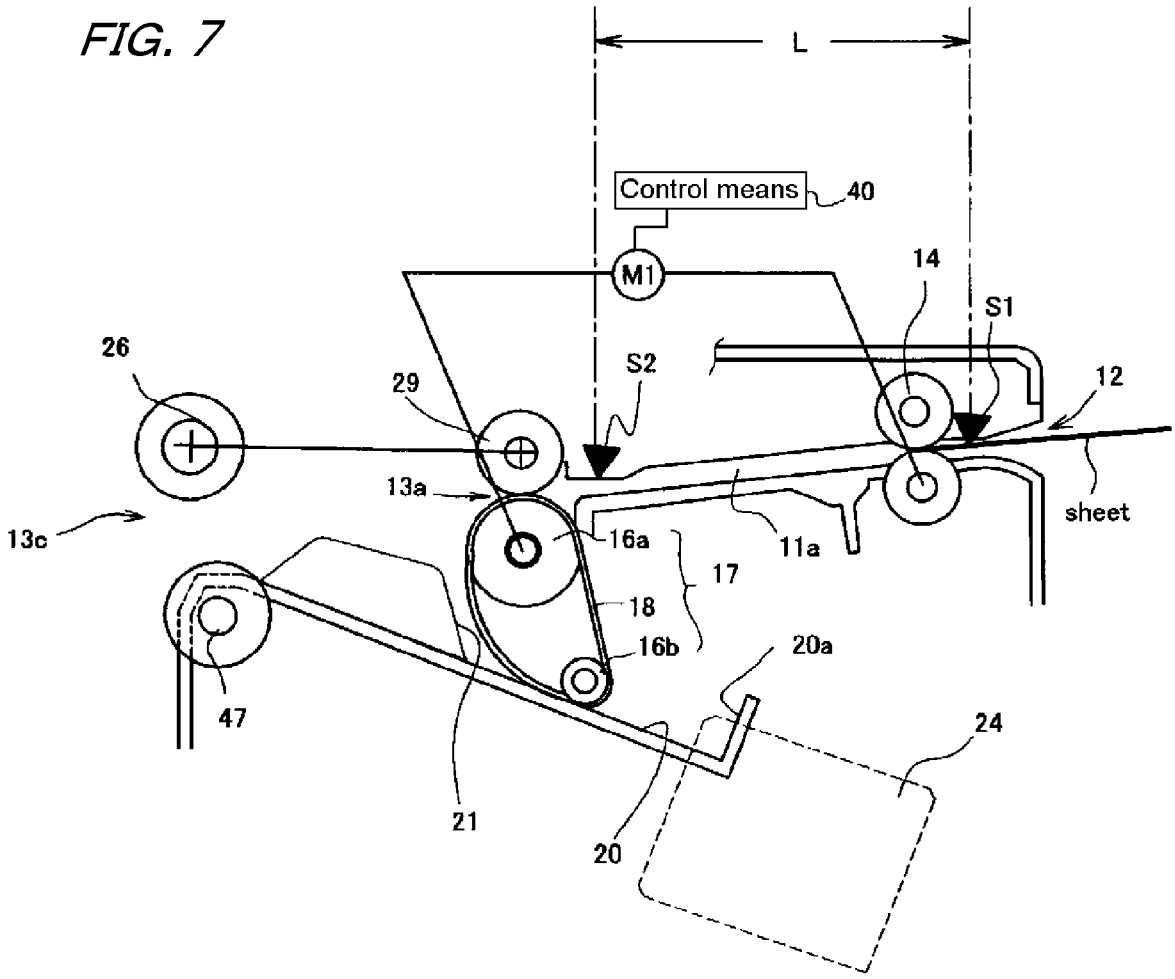
FIG. 7 is a diagram illustrating the arrangement of sensor means different from that in the apparatus shown in FIG. 2.

As shown in FIG. 7, a first sensor S1 and a second sensor S2 are arranged on the sheet discharging path 11 at a distance L from each other. The first sensor S1 senses the leading or trailing end of the sheet, and the sheet end is then sensed by the second sensor. This enables detection of the "moving time" of the sheet moving over the distance L. The sheet slippage amount can be determined by configuring the remaining part of the apparatus as described above.

Now, a case where the control means 40 is configured so as to stop the belt transporting means 17 according to the "sheet-surface material nature input by the operator" will be described.

The case where the sheet conveying condition is detected to control the belt transporting means 17 will be described. Although not shown in the drawings, a control panel is provided on the image forming apparatus A or the finisher B and includes an input key via which the operator inputs information. Then, for example, the panel display section displays choices such as "coating paper" and "plain paper." The "belt stop time" is set on the basis of the material-nature and sheet-size information selected by the operator. The control means 40 sets the "belt stop time" on the basis of the material and sheet size information specified via the input key. The other operations are similar to those described above and will thus not be described below.

The present application claims priority from Japanese Patent App. No. 2007-203767, which is herein incorporated by reference.

What is claimed is:

1. A sheet stacking device comprising:

a sheet discharging port through which sheets are sequentially carried out;

a sheet discharging path connected to said sheet discharging port, for feeding sheets therefrom;

tray means disposed downstream of said sheet discharging path;

a sheet-end regulating member provided on the tray means;

conveying means for transporting toward said sheet-end regulating member sheets carried out onto the tray means through the sheet discharging port, said conveying means configured so as, in conveying toward said sheet-end regulating member a sheet having been carried in onto said tray means, to impart conveyance force to the sheet for a running time predetermined according to the nature of the sheet's surface material to keep the sheets orderly stacked on said tray means;

conveyance control means for controlling said conveying means to impart the conveyance force to the sheet for the predetermined running time; and sensor means provided in said sheet discharging path and comprising a sensor for detecting the leading and trailing ends of a moving sheet, said sensor means therein for detecting pass time of a sheet being conveyed on said sheet discharging path, and outputting a pass-time determining output signal to said conveyance control means; wherein said conveyance control means comprises comparing means for comparing the sheet-pass time as determined by the output signal from said sensor means with a preset reference sheet-pass time, and said conveyance control means predetermines said running time based on the comparison result from said comparing means.

2. The sheet stacking device according to claim 1, wherein said conveying means comprises a belt member disposed in between said sheet discharging port and the uppermost sheet that can be on the tray means.

3. A finisher comprising the sheet stacking device of claim 1, wherein:

said tray means is a finisher processing tray on which sheets carried out from an image forming apparatus are collated into a bundle; and the finisher comprises final-stage processing means for subjecting a sheet bundle on said processing tray to final-stage processing.

4. The finisher according to claim 3, wherein said conveying means comprises:

a first conveyance means for transporting toward said sheet-end regulating member sheets carried out onto the tray means through the sheet discharging port; and a second conveyance means, upstream of said first conveyance means, provided to allow second conveyance means to shift between an engagement position in which said second conveyance means engages a sheet discharged onto said tray means and transports the sheet toward said first conveyance means, and a standby position separated from the engagement position.

5. The finisher according to claim 4, wherein in the engagement position, second conveyance means, after having transported a sheet in the conveying-out direction from the sheet discharging port switches the sheet back and conveys it to said first conveyance means.

6. The sheet stacking device according to claim 1, wherein said conveying means comprises:

a first conveyance means for transporting toward said sheet-end regulating member sheets carried out onto the tray means through the sheet discharging port; and a second conveyance means, upstream of said first conveyance means, provided to allow second conveyance means to shift between an engagement position in which said second conveyance means engages a sheet discharged onto said tray means and transports the sheet toward said first conveyance means, and a standby position separated from the engagement position.

7. The sheet stacking device according to claim 6, wherein in the engagement position, second conveyance means, after having transported a sheet in the conveying-out direction from the sheet discharging port switches the sheet back and conveys it to said first conveyance means.

8. A sheet stacking device comprising:

a sheet discharging port through which sheets are sequentially carried out;

a sheet discharging path connected to said sheet discharging port, for feeding sheets therefrom;

tray means disposed downstream of said sheet discharging path;

a sheet-end regulating member provided on the tray means;

conveying means for transporting toward said sheet-end regulating member sheets carried out onto the tray means through the sheet discharging port, said conveying means configured so as, in conveying toward said sheet-end regulating member a sheet having been carried in onto said tray means, to impart conveyance force to the sheet for a running time predetermined according to the nature of the sheet's surface material to keep the sheets orderly stacked on said tray means;

conveyance control means for controlling said conveying means to impart the conveyance force to the sheet for the predetermined running time; and sensor means provided in said sheet discharging path and comprising sensors for detecting a sheet moving over a predetermined distance spanning an interval, said sensor means therein for detecting pass time of a sheet being conveyed on said sheet discharging path, and outputting a pass-time determining output signal to said conveyance control means; wherein said conveyance control means comprises comparing means for comparing the sheet-pass time as determined by the output signal from said sensor means with a preset reference sheet-pass time, and said conveyance control means predetermines said running time based on the comparison result from said comparing means.

9. The sheet stacking device according to claim 8, wherein said conveying means comprises a belt member disposed in between said sheet discharging port and the uppermost sheet that can be on the tray means.

10. A finisher comprising the sheet stacking device of claim 8, wherein:

said tray means is a finisher processing tray on which sheets carried out from an image forming apparatus are collated into a bundle; and the finisher comprises final-stage processing means for subjecting a sheet bundle on said processing tray to final-stage processing.

11. The finisher according to claim 10, wherein said conveying means comprises:

a first conveyance means for transporting toward said sheet-end regulating member sheets carried out onto the tray means through the sheet discharging port; and a second conveyance means, upstream of said first conveyance means, provided to allow second conveyance means to shift between an engagement position in which said second conveyance means engages a sheet discharged onto said tray means and transports the sheet toward said first conveyance means, and a standby position separated from the engagement position.

12. The finisher according to claim 11, wherein in the engagement position, second conveyance means, after having transported a sheet in the conveying-out direction from the sheet discharging port switches the sheet back and conveys it to said first conveyance means.

13. The sheet stacking device according to claim 8, wherein said conveying means comprises:

a first conveyance means for transporting toward said sheet-end regulating member sheets carried out onto the tray means through the sheet discharging port; and a second conveyance means, upstream of said first conveyance means, provided to allow second conveyance means to shift between an engagement position in which said second conveyance means engages a sheet discharged onto said tray means and transports the sheet toward said first conveyance means, and a standby position separated from the engagement position.

14. The sheet stacking device according to claim 13, wherein in the engagement position, second conveyance means, after having transported a sheet in the conveying-out direction from the sheet discharging port switches the sheet back and conveys it to said first conveyance means.

* * * * *